US006296141B1

(12) United States Patent
Lukacevic

(10) Patent No.: US 6,296,141 B1
(45) Date of Patent: Oct. 2, 2001

(54) SPLASH-PROOF LID

(76) Inventor: Temo Lukacevic, 268 W. 72nd St., New York, NY (US) 10023

( * ) Notice: Subject to any disclaimer, the term of this patent is extended or adjusted under 35 U.S.C. 154(b) by 0 days.

(21) Appl. No.: 09/545,159

(22) Filed: Apr. 7, 2000

Related U.S. Application Data

(63) Continuation-in-part of application No. 09/095,419, filed on Jun. 8, 1998, now abandoned.

(51) Int. Cl.[7] ..... A47G 19/22
(52) U.S. Cl. ..... 220/713; 220/707; 220/719
(58) Field of Search ..... 220/713, 719, 220/521, 212, 780, 711, 712, 714, 716, 703, 705, 707; 229/404

(56) References Cited

U.S. PATENT DOCUMENTS 0,908,706 * 1/1909 Sprinkle ..... 220/713
3,360,161 * 12/1967 Smith ..... 220/719
4,322,014 * 3/1982 Philip ..... 220/713
4,394,928 * 7/1983 Philip ..... 220/719
4,767,019 * 8/1988 Horner ..... 220/713
5,542,670 * 8/1996 Morano ..... 220/719

FOREIGN PATENT DOCUMENTS

2053865-A * 2/1981 (GB) ..... 220/719

* cited by examiner

*Primary Examiner*—Gene Mancene
*Assistant Examiner*—Niki M. Eloshway
(74) *Attorney, Agent, or Firm*—Bierman, Muserlian and Lucas

(57) ABSTRACT

The splash-proof lid uses a capillary tube which is attached to the bottom of the lid and forms an angle of 60°. The arc capillary tube has two openings at each end which are in fluid communication with the drinking hole in the lid. The air hole is positioned at the center of the lid.

3 Claims, 1 Drawing Sheet

SPLASH-PROOF LID

CROSS-REFERENCE TO RELATED APPLICATIONS

This application is a continuation-in-part application of U.S. patent application Ser. No. 09/095,419 filed Jun. 8, 1998, now abandoned.

BACKGROUND OF INVENTION

1. Field of Invention

This invention relates to a removable lid for a cup and, more particularly, to a lid which has both an air hole and a drinking hole through which a user can drink the liquid contents of the cup. The lid prevents inadvertent splashing which occurs due to unintentional movement of the cup.

2. Art Related to Invention

Splash-proof lids for drinking cups are known. Typically, they comprise a round, removable cover which fits tightly over the top opening of a cup to prevent unwanted spillage of the contents of the cup while allowing the user to drink the contents of the cup even though the lid remains on the cup. To allow the user to drink the contents of the cup while the lid remains on the cup, both a drinking hole and an air hole are provided in the lid. Both holes are configured to prevent unwanted loss or spillage of the contents of the cup which occurs when the cup is unintentionally moved. Typically, such lids are used on disposable cups which the user takes on a train, a plane, in a boat, or in a car.

The drinking hole is usually positioned at the edge of the lid next to the side wall of the cup, while the air hole is positioned either centrally in the lid or along the edge of the lid next to the side wall of the cup, opposite the drinking hole.

One example of such a lid is taught in U.S. Pat. No. 4,322,014. In the '014 patent, a splash-proof lid has both a drinking hole and an air hole wherein both holes have a baffle arrangement to prevent the liquid contents of the cup from exiting the cup. The baffle arrangement is such that the axis of the baffle, taken along the fluid flow lines, forms a straight line and does not follow the contour or radius of the exterior of the lid. The baffle arrangement in the '014 patent is rather complicated.

Another example of such a lid is taught in U.S. Pat. No. 4,394,928. Here a special cup having a ledge functions with the lid to form a curved channel through which liquid flows to the drink hole. Thus, a special cup must be employed to allow the lid to function.

There is a need for a simplified design for a splash-proof lid which can function with a conventional disposable cup.

SUMMARY OF THE INVENTION

A simplified splash-proof drinking lid for a cup has now been discovered. The lid is intended to be disposable and for use with disposable drinking cups such as the type used for coffee, tea, etc. The lid has an air hole and a drinking hole and is designed to avoid spillage of the contents of the cup through the drinking hole.

It has been discovered that the jiggling or unintended movement of the cup causes a wave to form on the surface of the liquid and to travel back and forth across the surface of the liquid crashing against the side walls of the cup. When the wave hits the side walls of the cup, it splashes out of the drinking hole or the air hole when the air hole is positioned next to the side wall of the cup. Thus, it is the movement of the waves on the surface of the liquid in the cup and its crashing against the side wall that causes the splashing and the spillage of the liquid.

It has also been found that when the air hole is made small and positioned in the center of the lid that splashing or spillage due to the wave through the air hole does not occur. Furthermore, it has been found that when the air hole is made rather small compared to the drinking hole, that the air hole will still function to allow liquids to flow out of the drinking hole and air in through the air hole. Thus, in the present invention, the air hole is positioned in the center of the lid and made relatively small compared to the drinking hole. To avoid spillage through the drinking hole, an arc capillary tube is employed. The arc capillary tube of the present invention has been found to redirect the liquid back into the cup and prevent spillage of the contents of the cup through the drinking hole.

The arc capillary tube is positioned on the bottom of the lid, directly below the drinking hole, and is in fluid communication with the drinking hole. The arc capillary tube follows the curvature of the lid and is centered on the drinking hole. The arc capillary tube is formed along the edge of the lid and has an opening at either end to allow for the liquid contents of the cup to travel into the capillary tube. The capillary tube is also in fluid communication with the drinking hole to allow the liquid contents to flow from the capillary tube through the drinking hole and into the user's mouth. The radius of the arc capillary tube is less than the radius of the lid and the radius of the arc capillary tube is concentric with the radius of the lid.

The lid itself has an engaging periphery to allow it to engage the rim of a cup and become removably affixed to the rim of the cup. In this way, the lid of the present invention fits a conventional disposable cup and no special arrangement need be made nor a special cup employed in the present invention.

Broadly, the splash-proof lid for a drinking cup in accordance with the present invention comprises: a circular disc having a snap fitting periphery for engagement with a cup rim; a drinking hole in said disc which is positioned adjacent to said snap fitting periphery; an air hole in said disc which is positioned in the center of said disc, said air hole being smaller than said drinking hole; and an arc capillary tube attached under said disc and centered on said drinking hole, said arc capillary tube being in fluid communication with said drinking hole, said arc capillary tube having a radius that is concentric with the radius of said disc and less than the radius of said disc, said arc capillary tube having two inlet openings, one at each end of said arc capillary tube, such that both inlet openings allow fluid communication between themselves and said drinking hole by means of said capillary tube. Preferably, the arc capillary tube forms an angle of 60°. More preferably, the arc capillary tube is rectangular in cross-section.

BRIEF DESCRIPTION OF DRAWINGS

These and other aspects of the present invention may be more fully understood by reference to one or more of the following drawings wherein.

DETAILED DESCRIPTION OF INVENTION

Figure 1:
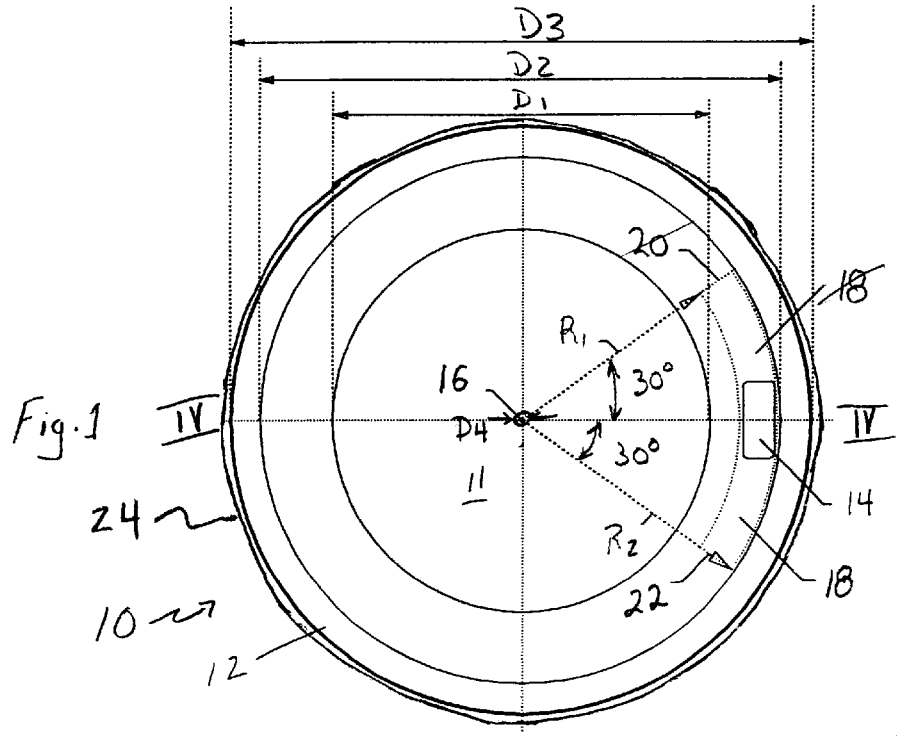
FIG. 1 is a top view of the lid of the present invention.
Figure 2:
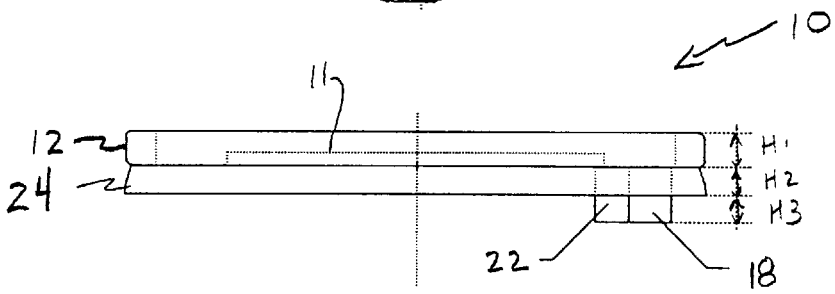
FIG. 2 is a side view of the lid of the present invention.

FIG. 1 illustrates a top view of lid 10 which is a circular disc having raised center section 11 on top thereof, snap fitting periphery 12 along the sides thereof, drinking hole 14 extending therethrough, air hole 16 extending therethrough, and capillary tube 18 mounted on the bottom thereof.

Capillary tube 18 has two inlet openings 20 and 22. Capillary tube 18 is in fluid communication with drinking hole 14 such that when a user drinks from cup 30, the liquid contents of cup 30 flow through inlet openings 20, 22 into capillary tube 18 and through capillary tube 18 to drinking hole 14 and into the user's mouth.

Figure 4:
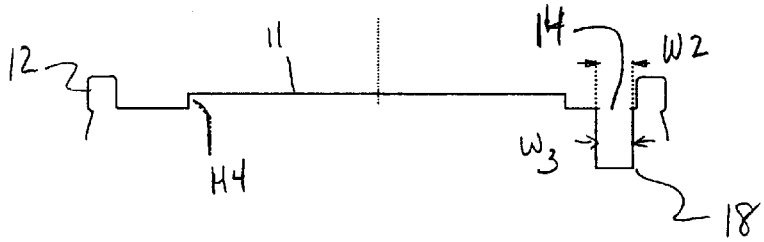
FIG. 4 is a cross-section of the lid of the present invention taken along lines IV—IV of FIG. 1.

As shown, capillary tube 18 is arced to form a 60° angle. Capillary tube 18 is centered on drinking hole 14 as shown in FIG. 1. Capillary tube 18 is preferably rectangular in cross-section as shown in FIG. 4, however, it may take on other cross-sections.

Figure 3:
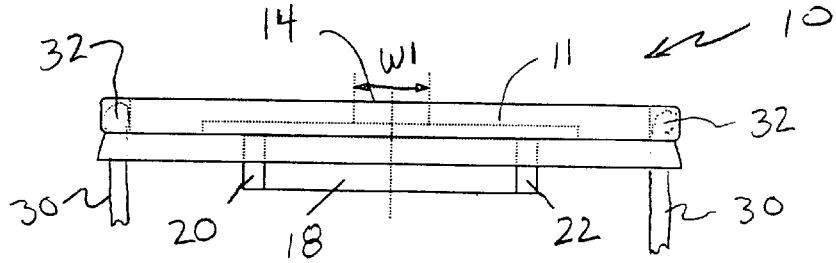
FIG. 3 is a side view of the lid of the present invention rotated 90° from the view of FIG. 2.

Lid 10 is securely held on cup 30 due to the engagement between snap fitting periphery 12 and lip 32 of cup 30 when placing lid 10 onto cup 30. Lip 32 is guided into snap fitting periphery 12 by edge 24. Such an engagement is conventional and well-known to those of skill in the art. Snap fitting periphery 12 securely houses lip 32 as shown in FIG. 3.

As a specific example of the present invention, the dimensions of lid 10 are as follows:

D1, diameter of raised center section 11=55 mm.
D2, inside diameter of lid 10=76 mm.
D3, outside diameter of lid 10=85 mm.
D4, diameter of air hole.
R1, inner radius of capillary tube 18=32 mm.
R2, outer radius of capillary tube 18=37.6 mm.
H1, height of snap fitting periphery 12=5 mm.
H2, height of edge 24=4 mm.
H3, height of capillary tube 18 extending below edge 24=4 mm.
H2+H3, height of capillary tube 18=8 mm.
H4, height of raised center section 11=2 mm.
W1, long width of drinking hole 14=11 mm.
W2, short width of drinking hole 14=5.4 mm.
W3, width of capillary tube 18=5.6 mm.

These measurements are for one embodiment where the external diameter of the cup is 85 mm. Obviously, the dimensions of the lid are adjusted accordingly, depending on the size of the cup. As is typical, disposable cups are made generally in three sizes, small, medium and large, and the lid of the present invention is accordingly adjusted for these different cup dimensions.

The lid of the present invention is preferably made by molding a plastic material. The lid is preferably made in a single molding operation wherein a moveable die is used to form capillary tube 18. The moveable die is moved after the molding operation to allow the removal of lid 10 from the mold. Such molding is conventional and is conducted in a conventional manner using conventional molding techniques.

Alternatively, capillary tube 18 can be separately molded and then affixed to the bottom of the disc which makes up the lid 10. In order to do this, capillary tube 18 would be glued or affixed in a conventional manner to the bottom of lid 10.

As can be appreciated by those of skill in the art, a single step molding operation is preferred and, in accordance with the present invention, a one piece molded plastic lid is made.

In accordance with the present invention, if any liquid is forced into capillary tube 18, it will be sent back into cup 30 by redirecting the wave of the liquid.

As will be appreciated by those of skill in the art, the spill free lid of the present invention is easy to manufacture and is capable of nesting with other lids of like construction. The nesting is made possible because H1 is greater than H3. Thus, the portion of the capillary tube 18 that extends below edge 24 will fit inside the portion of the lid defined by the inside diameter of lid 10 while edge 24 rests against the top of snap fitting periphery 12.

As will also be appreciated, should any liquid exit from drinking hole 14, it will be caught in the moat defined by raised section 11 and snap fitting periphery 12.

It will be understood that the claims are intended to cover all changes and modifications of the preferred embodiment of the invention herein chosen for the purpose of illustration which do not constitute a departure from the spirit and scope of the invention.

What is claimed is:

1. A splash-proof lid for a drinking cup comprising:

a circular disc having a snap fitting periphery for engagement with a cup rim;

a drinking hole in said disc which is positioned adjacent to snap fitting periphery;

an air hole in said disc which is positioned in the center of said disc, said air hole being smaller than said drinking hole; and an arc capillary tube attached under said drinking hole at the bottom of said disc and adjacent to said snap fitting periphery, said arc capillary tube in fluid communication with said drinking hole, said arc capillary tube having a radius that is concentric with the radius of said disc and less than the radius of said disc, said arc capillary tube being centered on said drinking hole, said arc capillary tube having two inlet openings, one at each end of said arc capillary tube, such that said inlet openings are in fluid communication with said drinking hole to allow the user to drink through the lid when the lid is placed on top of the drinking cup.

2. The splash-proof lid of claim 1 wherein said arc capillary tube forms an angle of 60°.

3. The splash-proof lid of claim 1 wherein said arc capillary tube has a rectangular cross-section.

* * * * *